United States Patent [19]

Sweeney

[11] 4,440,449

[45] Apr. 3, 1984

[54] MOLDING PILLARS IN UNDERGROUND MINING OF OIL SHALE

[75] Inventor: William A. Sweeney, Larkspur, Calif.

[73] Assignee: Chevron Research Company, San Francisco, Calif.

[21] Appl. No.: 346,185

[22] Filed: Feb. 5, 1982

[51] Int. Cl.[3] ..... E21C 41/10

[52] U.S. Cl. ..... 299/11; 405/267

[58] Field of Search ..... 299/11; 405/266, 267

[56] References Cited

U.S. PATENT DOCUMENTS 4,198,097 4/1980 Fondriest ..... 299/11

4,219,237 8/1980 Sisemore ..... 299/11 X

OTHER PUBLICATIONS

Rose et al., "Proposed Coal Pillaring Procedure", etc. Society of Mining Engineering, Mar. 1979, pp. 291-297.

*Primary Examiner*—Ernest R. Purser

*Attorney, Agent, or Firm*—Burns, Doane, Swecker & Mathis

[57] ABSTRACT

An improvement in room-and-pillar mining of underground oil shale deposits in which: spaces between the pillars are filled with a fluid cementitious composition comprising spent oil shale and a binder to form floor-to-ceiling bodies of the composition; the bodies are allowed to harden to form support members for supporting the roof of the mine cavity; and the pillars are thereafter mined from the mine cavity.

4 Claims, 3 Drawing Figures

MOLDING PILLARS IN UNDERGROUND MINING OF OIL SHALE

BACKGROUND OF THE INVENTION

1. Field of the Invention

The invention is in the field of subsurface mining of oil shale. More particularly the invention relates to an improvement in the underground mining of oil shale whereby that portion of the underground shale deposit that is normally left unmined for structural support purposes is recovered.

2. Description of the Prior Art

When underground oil shale deposits are mined it is necessary to provide structural support for the roof of the mine cavity. One way of providing such support is to leave vertical segments or pillars of unmined shale within the cavity to support the roof. These pillars often account for 30% to 40% by volume of the entire shale deposit. Leaving such a high proportion of the deposit unmined obviously detracts from the efficiency and economy of the underground shale mining operation. It would, therefore, be highly desirable to be able to remove these pillars and recover the kerogen therefrom. One obvious solution to this problem is to install support beams of wood or metal in the cavity and then remove the pillars. This solution, while workable, is not practical because the cost of obtaining such beams, transporting them to the mine site—which is typically in a remote area—and installing the beams in the mine cavity would far outweigh the incremental income realized by mining and retorting the pillars.

A principal object of the present invention is to provide an effective and relatively inexpensive technique for supporting the roof of underground oil shale mines to permit removal of the entire shale deposit. The technique uses spent oil shale—a material that is normally in ready and proximate supply—to form alternative support members in the mine. In this regard cementitious spent shale composites have been used previously in the construction field to make liners and caps for spent shale containment basins and to make linings for irrigation ditches and dams. Applicant knows of no use or suggested use of spent oil shale in making heavy vertical support members.

SUMMARY OF THE INVENTION

The invention is an improvement in a process for underground mining of a subsurface deposit of oil shale wherein the deposit is mined so as to form an underground cavity having a multiplicity of spaced, unmined vertical pillars that provide support for the roof of the cavity. The improvement is a technique that permits the unmined pillars to be mined. It comprises: filling spaces between the vertical pillars with a fluid, cementitious composition comprising spent oil shale and binder to form a multiplicity of bodies of said composition that extend from the floor of the cavity to the roof thereof between the pillars; allowing the bodies to harden whereby support members for supporting the roof of the cavity are formed; and thereafter mining the vertical pillars from the cavity.

BRIEF DESCRIPTION OF THE DRAWINGS

The drawings, which are not to scale illustrate an underground room-and-pillar mining operation using the invention. More specifically.

DETAILED DESCRIPTION OF THE INVENTION

Figure 1:
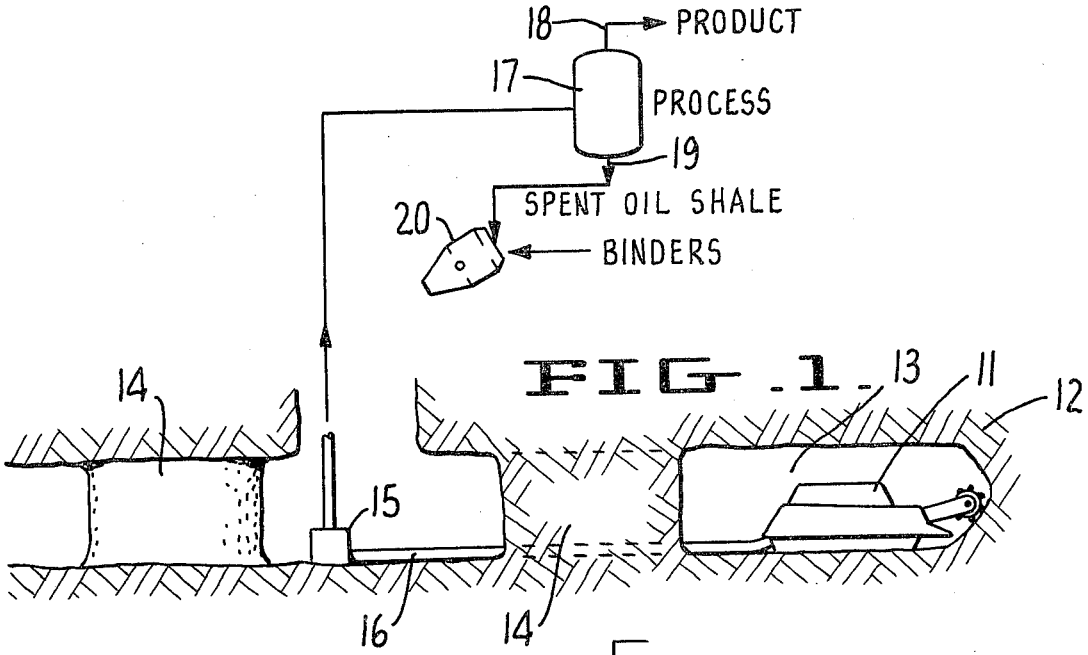
FIG. 1 is a partly schematic elevational view showing underground room-and-pillar mining of oil shale and the processing of the mined oil shale.

The cementitious composition that is used in the invention is a hydraulic cement, i.e., it sets, hardens, and does not disintegrate in water. Upon hardening it forms a cohesive solid body having strength and dimensional stability that is characteristic of load bearing members used in heavy construction. Before it sets and hardens, the composition comprises a fluid slurry of particulate spent oil shale and binder in water. The spent oil shale component preferably has a low residual carbon (char) content, typically less than about one percent by weight, and a substantial portion of its Mg, Ca, and Fe carbonate decomposed to corresponding oxides. Usually, at least about 15% by weight, preferably 20% to 35% by weight of said carbonates are decomposed to corresponding oxides. In this regard calcite and dolomite or ankerite are the principal Mg/Fe/Ca carbonate minerals of most oil shales. The extent to which these minerals are present varies in different shale deposits. In shales from the Green River deposit in Colorado, Utah, and Wyoming these minerals normally constitute about 20% to about 60%, more usually 30% to 40%, by weight of the mineral composition of the shale. The retort/combustion conditions, principally temperature and time, to which the shale is subjected will determine the extent to which these carbonate minerals are decomposed to carbon dioxide and oxides. Under conditions normally used in retorting/combustion, mainly dolomite or ankerite will be decomposed with little calcite being decomposed. However, use of higher than normal retorting or combustion temperatures may result in significant calcite decomposition. The spent shale particle size will usually be below about one cm and usually below about 0.5 cm. The spent shale will usually constitute 45% to 94% by weight of the slurry.

Although the shale component of the composition may itself have inherent cementitious properties, the binder component is at least partly responsible for the composition's ability to harden into an aggregate of considerable strength and dimensional stability. The binder may be inorganic such as portland cement, natural cement, limestone, hydrated lime, and sulfur or organic such as the various emulsion polymerizable latexes. Combinations of such binders may also be used. Portland cement is a preferred binder. The binder will usually constitute 1% to 20% by weight of, preferably 2% to 15% by weight of the slurry.

The third major component of the slurry, water, is present in a sufficient amount to provide a continuous phase and make the composition fluid. Also, depending upon the binder, it should also be present in amounts sufficient to hydrate the binder and form bonded aggregates therewith. Within these limitations, it is desired for conservation reasons to use the minimal amount of water in the composition that will provide a hardened cementitious mass having the required load bearing properties. The optimal amount of water, in terms of obtaining optimal load bearing properties, will vary depending on the particular compositions of the spent shale and binder. This amount may be determined by making mixtures of varying water content, curing those mixtures and measuring the physical properties, e.g. compressive strength, of the cured mass by conventional test procedures. Compressive strength may be determined by ASTM D 1633-68. In most instances the optimal amount of water will be in the range of about 5% to about 50% by weight.

The above described compositions may be used to practice the invention in the manner shown in the drawings. In FIG. 1 oil shale is being mined underground in a room-and-pillar fashion using a wall mining machine 11. The mining machine dislodges oil shale from the walls 12 of the mine cavity 13 and collects the dislodged shale. As shown, the mining is carried out so as to leave a multiplicity of pillars 14 within the cavity. These pillars provide support for the roof of the cavity. The shale is transported from the mining machine to an elevator 15 by a conveyor 16. The elevator lifts the mined shale to the surface where it is transported by conventional equipment from the mine site to an oil shale processing plant 17. Plant 17 basically retorts the oil shale to produce a crude shale oil product (shown being taken overhead via line 18) and spent oil shale (shown being taken as bottoms via line 19). As used herein the term "spent oil shale" includes those materials referred to in the art as retorted shale (shale from which substantially all of the kerogen has been pyrolyzed but which still contains residual char) and combusted shale (retorted shale from which at least a substantial portion of the char has been burned). The composition of spent shale is described above.

Figure 2:
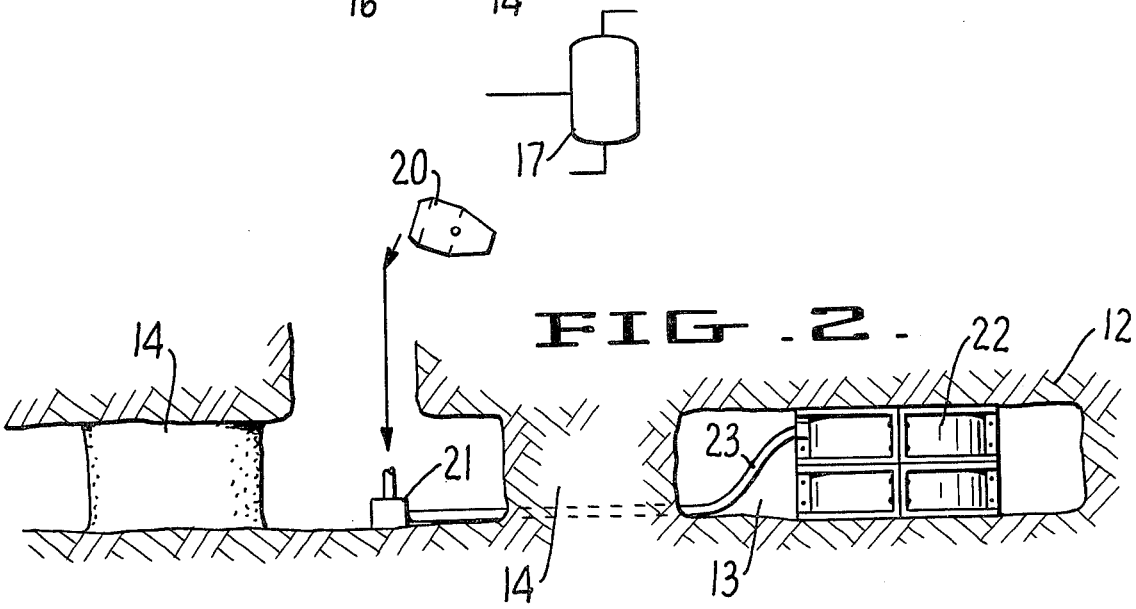
FIG. 2 is a partly schematic elevational view showing the formation of a roof support member within the mining using a spent oil shale-binder composition.
Figure 3:
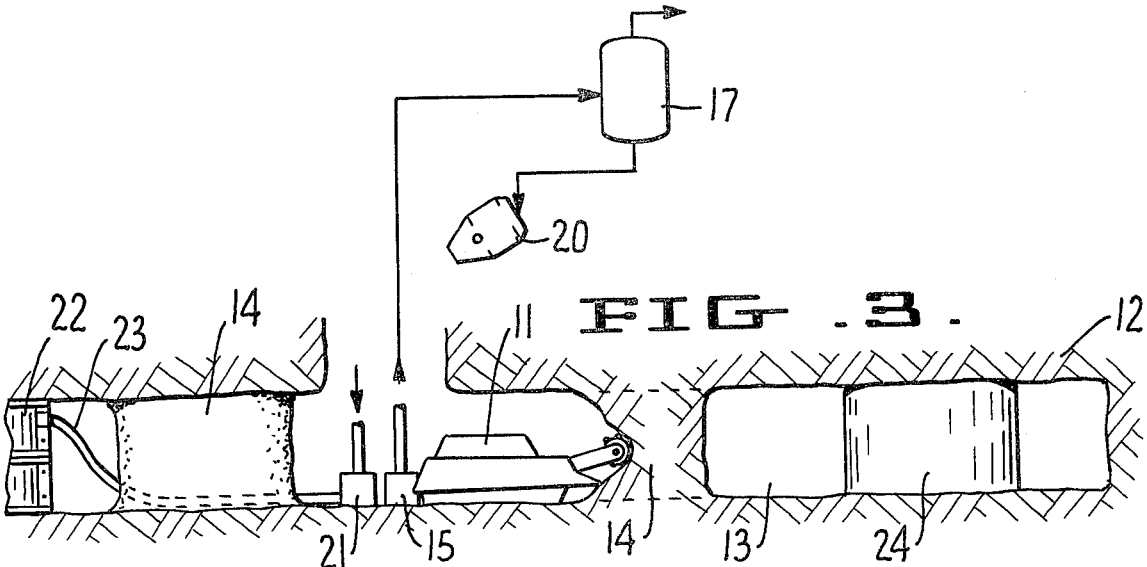
FIG. 3 is a partly schematic elevational view showing the mining of the pillars after the formation of said roof support member.

A portion of the spent oil shale is conveyed from plant 17 to a mixer 20 where the shale is mixed in appropriate proportions (described above) with binder(s) and water. The mixer will usually be located at the mine site. Referring to FIG. 2, the aqueous spent shale-binder slurry is conveyed from the mixer into a pump 21 located on the floor of the mine cavity. The pump discharges the slurry into a support member mold 22 via a flexible hose or conduit 23. As illustrated, the mold is positioned in a space between pillars and extends from the floor to the ceiling of the mine cavity. It has roughly the same, or larger, dimensions as a pillar and is made from a multiplicity of interconnecting panels so that it can be assembled, disassembled, and transported easily. After the mold is filled with the slurry the hose inlet is blocked with appropriate plug or closure means (not shown). The slurry is then allowed to set, dry, and harden. It may be advantageous to do this operation in stages, i.e. partially fill, allow that to harden, fill further, and so on until the cavity is completely filled. This would avoid problems from shrinkage and would require less strength in the mold. The mold is then disassembled, removed from the exterior of the hardened mass (designated 24 in FIG. 3) and reassembled at another site as shown in FIG. 3. As seen in FIG. 3 mass 24 constitutes an additional roof support member that is capable of bearing a load comparable to that which an unmined pillar bears. With the roof thus supported by such support member(s), the adjacent pillar(s) may be mined. The mining of a pillar by the mining machine is shown in FIG. 3. The mining of pillars and formation of additional artificial roof support members may be carried out simultaneously as shown in FIG. 3. In this manner the pillars are replaced with artificial support members and then mined. Such operation significantly increases the efficiency and economy of the mining operation. It also provides a beneficial use for spent oil shale which would otherwise go unused and be disposed of as waste.

Modifications of the above described process that are obvious to those of skill in the mining, construction, and cement formulation arts are intended to be within the scope of the following claims.

I claim:

1. In a process for underground mining of a subsurface deposit of oil shale wherein the deposit is mined and removed so as to form an underground cavity having a multiplicity of spaced unmined pillars that provide support for the roof of the cavity, the improvement comprising:

(a) assembling a mold in a space between unmined pillars;

(b) filling the mold with a fluid cementitious composition comprising (i) 45% to 94% by weight of shale having a residual carbon content less than about one percent by weight and 20% to 35% by weight of its Mg, Ca, and Fe carbonates decomposed to the corresponding oxides, (ii) 1% to 20% by weight of a binder, and (iii) 5% to 50% by weight of water to form a body of said composition that extends vertically from the floor of the cavity to the roof thereof between the pillars;

(c) allowing the body to harden whereby a support member is formed for supporting the roof of the cavity; and (d) disassembling the mold.

2. The process of claim 1 wherein the binder is portland cement.

3. The process of claim 1 wherein said mold is reassembled in a different space and steps (b) through (d) are repeated.

4. The process of claim 1 wherein the mold is filled in stages.

* * * * *